United States Patent [19]

Crisci

[11] Patent Number: 4,722,447

[45] Date of Patent: Feb. 2, 1988

[54] CLOSURE ASSEMBLY WITH TWO TAMPER INDICATORS

[75] Inventor: Robert E. Crisci, New Castle, Pa.

[73] Assignee: Northern Engineering and Plastics Corp., New Castle, Pa.

[21] Appl. No.: 932,667

[22] Filed: Nov. 20, 1986

[51] Int. Cl.[4] ..... B65D 5/64

[52] U.S. Cl. ..... 215/232; 215/252

[58] Field of Search ..... 215/252, 232, 350; 220/359

[56] References Cited

U.S. PATENT DOCUMENTS

| | | | |
|---|---|---|---|
| 2,180,199 | 11/1939 | Loibl, Jr. | 215/349 |
| 2,373,847 | 4/1945 | Osborne et al. | 215/232 |
| 2,937,481 | 5/1960 | Palmer | 53/39 |
| 3,352,268 | 11/1967 | Koll | 113/121 |
| 3,501,042 | 3/1970 | Risch et al. | 215/232 |
| 3,504,818 | 4/1970 | Crisci | 215/232 |
| 3,805,993 | 4/1974 | Enzle et al. | 220/60 |
| 3,812,994 | 5/1974 | Feldman | 215/256 |
| 4,171,084 | 10/1979 | Smith | 215/232 |
| 4,209,126 | 6/1980 | Elias | 215/250 |

FOREIGN PATENT DOCUMENTS

| | | | |
|---|---|---|---|
| 1255739 | 12/1971 | United Kingdom | 215/350 |

*Primary Examiner*—Stephen Marcus
*Assistant Examiner*—Nova Stucker
*Attorney, Agent, or Firm*—Harpman & Harpman

[57] ABSTRACT

A tamper indicating container and closure combination in which the container has configurations about the neck thereof registering with configurations on a separate portion of a closure engageable therewith, which separate portion is separated from the closure when the closure is removed from the container. A sealing disc is positioned in the closure by limited frictional engagement therewith so that when the closure is removed from the container, the separable portion of the closure remains on the container as an indicator and the sealing disc remains in sealing relation on the container and must be wholly or partially removed by a tab thereon to gain access to the contents of the container whereby the sealing disc and tab forms a second indicator.

4 Claims, 4 Drawing Figures

CLOSURE ASSEMBLY WITH TWO TAMPER INDICATORS

BACKGROUND OF THE INVENTION

1. Field of the Invention

This invention relates to containers and closures therefor designed to indicate the removal of the closure and to seal the container so that the purchaser may be assured that the contents of the container are as originally packed.

2. Description of the Prior Art

Prior structures of this type having break-away portions of a closure to indicate tampering are shown in U.S. Pat. Nos. 3,504,818 and 3,812,994. Sealing discs are illustrated in U.S. Pat. Nos. 2,180,199, 2,937,481, 3,352,268, 3,501,042, 3,805,993, 4,171,084 and 4,209,126. The sealing disc in U.S. Pat. No. 3,352,268 forms a flanged closure when applied to a container as does a sealing disc in U.S. Pat. No. 2,373,847.

The sealing discs in several of the prior art patents are adapted to be hermetically sealed to the container by incorporating a membrane adhesively affixed to the disc or alternately comprising a thermoplastic material which is compatible with and fusible to the material forming the container by heat directly or indirectly applied to the sealing disc.

SUMMARY OF THE INVENTION

Milk containers of the one gallon or half gallon size blow molded of resilient flexible plastic material employing resilient flexible plastic closure caps threadably or snap-on engaged thereon are widely used in distributing milk and many other products. The desirability of readily indicating to the final consumer the uncontaminated, unopened container has become increasingly necessary in recent years due to irresponsive tampering with the contents of containers and the widespread publicity concerning the same.

The present invention utilizes either a threaded or snap-on configuration in the closure cap and on the neck of the container, the closure having an integrally molded resilient plastic construction with an annular ring so formed as to be readily broken away when the closure is removed from the container so as to form a first indicator. A sealing disc is temporarily frictionally affixed within the closure for engagement with the neck of the container around and over the access opening therein in sealing relation and includes means adhering the sealing disc to the neck of the container in sealing relation with respect to the opening therein so that the sealing disc remains on the container in sealing relation when the closure is removed and the first indicator actuated. A plurality of circumferentially positioned radially extending tabs formed on the sealing disc initially serve to firmly position it within the closure so that it is carried thereby onto the neck of the container where it covers the access opening and adheres to the inturned annular flange of the container usually defining the opening. The tabs initially insure the positioning of the sealing disc in the closure and finally provide convenient means for engaging the sealing disc and forcibly partially or wholly removing the same from the container neck when exposing the access opening and thus provide a second indicator.

DESCRIPTION OF THE PREFERRED EMBODIMENT

Figure 3:
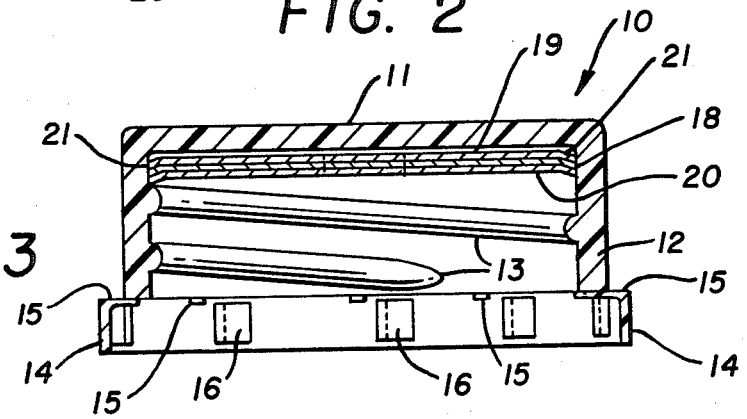
FIG. 3 is a vertical section of a resilient closure with a first tamper indicating separable ring thereon and a sealing disc frictionally positioned therein by the distortion of the circumferentially spaced tabs thereon.

In its illustrated form the closure assembly with two tamper indicators is best illustrated in FIG. 3 of the drawings wherein a closure cap 10 has a flat circular top portion 11 with an annular depending flange 12 on its peripheral edge and having a fastening configuration 13 on the inner surface of the annular depending flange 12. Alternately, the fastening configuration may be a continuous annular rib. A break-away annular ring 14 is integrally molded with the annular depending flange 12 by interconnecting frangible elements 15. A plurality of inwardly facing angular projections 16 are formed on the inner surface of the break-away annular ring 14 and are adapted to register with matching ratchet teeth around the neck of the container to which the closure is applied.

Still referring to FIG. 3 of the drawings, it will be seen that a sealing disc 17 is illustrated in self-holding frictional engagement in the closure cap 10 and adjacent the bottom of the to portion 11 thereof. The sealing disc 17 is shown in top plan view and cross section in FIGS. 1 and 2 of the drawings and by referring thereto it will be seen that it is preferably formed of two layers such as a thin metallic foil 18 and a relatively thicker paper 19. A coating of adhesive 20 is applied to the lower surface of the metallic foil 18 when a separate adhesive is employed or alternately the metallic foil may be heat fused to the neck of the container by electromagnetically induced heat therein as will be understood by those skilled in the art.

Figure 1:
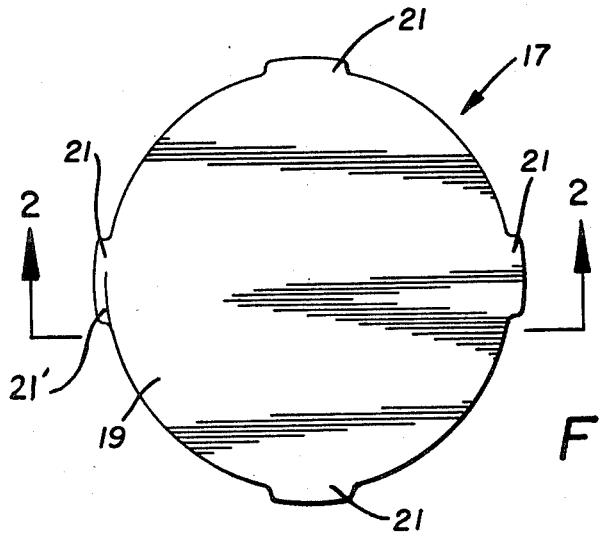
FIG. 1 is a top plan view of the sealing disc of the invention.
Figure 2:
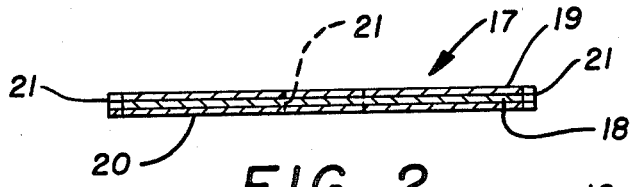
FIG. 2 is a horizontal section on line 2—2 of FIG. 1.
Figure 4:
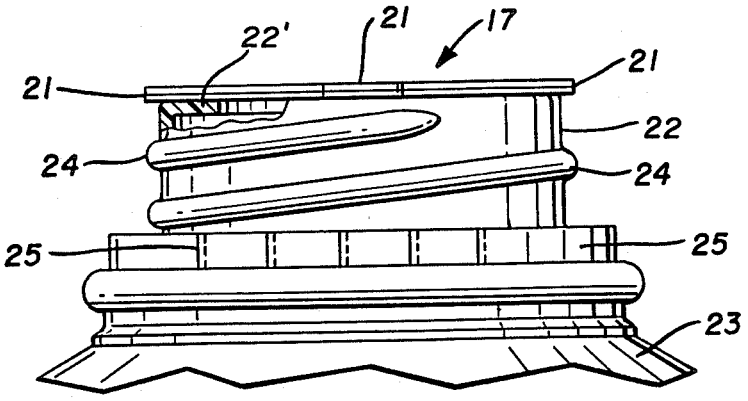
FIG. 4 is a side elevation of a container parts of which are broken away with the closure removed and the sealing disc sealingly closing the access opening to the container.

Still referring to FIGS. 1, 2 and 3 of the drawings, it will be seen that the sealing disc 17 is formed with a plurality of circumferentially spaced radially and circumferentially extending tabs 21 which are of a size such that the overall width of the sealing disc 17 and any pair of the tabs 21 is sufficiently greater than the inner diameter of the closure 10 that the tabs 21 must bend downwardly at an angle to horizontal when the sealing disc 21 is placed in the closure 10 adjacent the bottom of the top portion 11 thereof and as illustrated in FIG. 3 of the drawings. The bending action of the tabs 21 which curve when the sealing disc 17 is positioned in the closure 10 results in tension engagement of the tabs 21 with the inner annular wall of the closure 10 and thus insures the frictional engagement thereof with the closure 10 which is essential in maintaining the desirable positioning of the sealing disc 17 in the closure 10 when it is turned downwardly or snapped onto the fastening configurations on the neck 22 of a container 23 as illustrated in FIG. 4 of the drawings, a slit 21' cuts part of a tab 21 on the disc 17. The slit 21' separates part of the tab 21 from the disc 17 to form a convenient handle for removing the disc 17 from the container 23.

By referring to FIG. 4 of the drawings, a portion of a container 23 is illustrated in communication with the upstanding neck 22 which carries fastening configurations 24 which match the fastening configurations 13 in the closure 10. The fastening configurations may be spiral thread patterns as illustrated or simple annular ribs or portions of ribs on the respective parts so that a snap together assembly is possible. In either event, the container is provided with a plurality of ratchet teeth 25 which are engaged by the inwardly facing angular projections 16 on the break-away annular ring 14 of the closure.

Still referring to FIG. 4 of the drawings, it will be seen that the sealing disc 17 with its projecting tabs 21 is illustrated in attached sealing relation on the upper end of the neck 22 primarily engaging the inturned horizontal flange 22' which is formed on the upper end of the neck 22 when the same is spin finished to define the access opening therein which is usually of a smaller diameter than the diameter of the neck 22.

The sealing disc 17 being attached either by adhesive or heat sealing to the uppermost portion of the neck 22 of the container 23, must be partially or wholly removed in order to obtain access to the opening to the container and it can therefore be partially or wholly lifted by engaging the extending tabs 21, which clearly indicates that the sealing tab has been moved, such as partially lifted or wholly removed and providing a second indicator of tampering with the closure assembly.

Although but one embodiment of the present invention has been illustrated and described, it will be apparent to those skilled in the art that various changes and modifications may be made therein without departing from the spirit of the invention or from the scope of the appended claims.

Having thus described by invention, I claim:

1. In the combination of a container having an inturned flange defining a top opening therein and a closure cap, a sealing disc in said cap and means on said sealing disc for removably adhering said sealing disc to said inturned flange, the improvement comprising; radially and circumferentially extending tabs on said sealing disc, at least one of said tabs being partially separated from said sealing disc by a slit whereby said tab forms an elongated handle for the removal of said sealing disc from said container.

2. The improvement defined in claim 1 wherein said sealing disc is formed of at least three layers of different materials, at least one of which is impervious to liquids and wherein said tabs are formed thereon.

3. The improvement defined in claim 1 wherein an elongated portion of one of said radially extending tabs on said sealing disc is separated from the sealing disc by a circumferentially extending slit whereby said elongated portion of said tab forms a handle for removing said sealing disc.

4. The improvement of claim 1 wherein said tabs are arranged in opposite disposed pairs.

* * * * *